US009546324B2

(12) United States Patent
Kumar et al.

(10) Patent No.: US 9,546,324 B2
(45) Date of Patent: Jan. 17, 2017

(54) METHOD FOR INCREASING GAS OIL YIELD AND ENERGY EFFICIENCY IN CRUDE OIL DISTILLATION

(71) Applicant: Council of Scientific and Industrial Research, New Delhi (IN)

(72) Inventors: Sunil Kumar, Dehradun (IN); Nanoti Shrikant Madhusudan, Dehradun (IN); Garg Madhukar Onkarnath, Dehradun (IN)

(73) Assignee: Council of Scientific and Industrial Research, New Delhi (IN)

( * ) Notice: Subject to any disclaimer, the term of this patent is extended or adjusted under 35 U.S.C. 154(b) by 71 days.

(21) Appl. No.: 14/531,276

(22) Filed: Nov. 3, 2014

(65) Prior Publication Data

US 2015/0122704 A1 May 7, 2015

(30) Foreign Application Priority Data

Nov. 1, 2013 (IN) ..... 3248/DEL/2013

(51) Int. Cl.
*C10G 7/00* (2006.01)

(52) U.S. Cl.
CPC ..... *C10G 7/00* (2013.01)

(58) Field of Classification Search
CPC ..... C10G 7/00; C10G 7/02; C10G 7/04
See application file for complete search history.

(56) References Cited

U.S. PATENT DOCUMENTS 4,082,653 A * 4/1978 DeGraff ..... C10G 7/00 208/251 R
7,172,686 B1 * 2/2007 Ji ..... C10G 7/00 208/251 R

OTHER PUBLICATIONS

Bagajewicz, Miguel, et al., "Rigorous Procedure for the Design of Conventional Atmospheric Crude Fractionation Units, Part I: Targeting", *Ind. Eng. Chem. Res.*, 40, (2001), 617-626.
Errico, Massimiliano, et al., "Energy saving in a crude distillation unit by a preflash implementation", *Applied Thermal Engineering*, 29, (2009), 1642-1647.
Golden, S. W., "Prevent preflash drum foaming", Hydrocarbon Processing, (May 1997), 141-153.
Ji, Shuncheng, et al., "Design of Crude Fractionation Units with Preflashing or Prefractionation: Energy Targeting", *Ind. Eng. Chem. Res.*, 41, (2002), 3003-3011.

* cited by examiner

*Primary Examiner* — Michelle Stein
(74) *Attorney, Agent, or Firm* — Schwegman Lundberg & Woessner, P.A.

(57) ABSTRACT

A method for significant increase in gas oil yield and energy efficiency in crude oil distillation is provided. The present invention relates to a method of separating the components of crude oil. This method utilizes the innovative and novel application of lighter fraction of crude through its superheating and its injection in the stripping section consisting of bottom to flash zone of main distillation column. Method also illustrates the innovative utilization of water in crude distillation unit to eliminate the bottom striping steam and for significant energy saving.

10 Claims, 4 Drawing Sheets

METHOD FOR INCREASING GAS OIL YIELD AND ENERGY EFFICIENCY IN CRUDE OIL DISTILLATION

CLAIM OF PRIORITY

This application claims the benefit of priority of India Patent Application Serial No. 3248/DEL/2013, entitled "METHOD FOR INCREASING GAS OIL YIELD AND ENERGY EFFICIENCY IN CRUDE OIL DISTILLATION," filed on Nov. 1, 2013, the benefit of priority of which is claimed hereby, and which is incorporated by reference herein in its entirety.

FIELD OF THE INVENTION

The present invention relates to a method for increasing gas oil yield and energy efficiency in crude oil distillation. More particularly, the present invention relates to the innovative application of lighter fraction of crude for increasing the yield of gas oil, reducing the energy consumption and generating the scope for capacity enhancement without crude distillation column revamp.

BACKGROUND OF THE INVENTION

Crude oil distillation unit is the first in which petroleum crude is processed. The brief description of the methods used for crude distillation based on the prior art Miguel Bagajewicz and Shuncheng Ji, Rigorous Procedure for the Design of Conventional Atmospheric Crude Fractionation Units. Part I: Targeting, Ind. Eng. Chem. Res. 2001, 40, 617-626; Shuncheng Ji and Miguel Bagajewicz, Design of Crude Fractionation Units with Preflashing or Prefractionation: Energy Targeting, Ind. Eng. Chem. Res. 2002, 41, 3003-3011; Shuncheng Ji, Katy Tex. (US), Miguel J. Bagajewicz, Norma, Ok (US), Methods for increasing distillates yield in crude oil distillation, 2007, U.S. Pat. No. 7,172, 686B1; Massimiliano Errico, Giuseppe Tola, Michele Mascia, Energy saving in a crude distillation unit by a preflashimplementation, Applied Thermal Engineering 29 (2009) 1642-1647; S. W. Golden, Prevent preflash drum foaming, Hydrocarbon Process. 76 (1997), 141-153. [U.S. Pat. No. 7,172,686B1, Ji and Bagajewicz, 2002; Errico, M., et. al. 2009, Bagajewicz and Shuncheng, 2001] are described below. Petroleum crude is first heated in a heat exchanger network using the hot products and pump around streams before entering a desalter. Water is either mixed with crude or fed to the desalter where most of the water soluble salt is removed. The desalted crude enters another heat exchanger network and receives heat from hot streams. The preheated crude then enters either to prefractionation column or preflash drum or furnace or combination of their off.

In case of prefractionation column, the top product of controlled distillation temperature range is routed to naphtha stabilizer directly. The vapor from the flash drum which requires further processing in main crude distillation column is either routed to column at any location above the flash zone or mixed to the liquid portion drawn from the flash drum before/after the furnace. The combinations of more than one preflash drum in series are also available in the prior art. In one of the combination, the heated crude is fed to flash drum where vapor and liquid are separated. The liquid from the flash drum is routed to furnace. The vapor from this flash drum is cooled in cooler and fed to the second flash drum. The vapor from second flash drum is then mixed with the liquid coming from the first flash drum before furnace. The liquid from the second flash drum is routed to the column at desirable location or to the side striper. In yet another combination reported in prior art, the vapor from the second flash drum, described above, is further cooled in the cooler and fed to yet another third flash drum. Vapor from third flash drum is mixed with crude coming from the first flash drum before furnace. The liquid from second and third are routed to the column at different location above the flash zone.

The crude coming from desalter/bottom of the flash drum/bottom of prefraction column is partially vaporized in the furnace and fed to the flash zone of the atmospheric column. The vapor from the flash zone moves upward in the column whereas liquid falls downwards to the bottom of column. The vapor is then fractionated into distillate products such as, not limited to, naphtha, kerosene, gas oil in upper section of the column. To recover the heat at different temperature level, several pump-around circuits along the column, where liquid streams are withdrawn, cooled, and sent back to upper trays are used along with the overhead condenser. The distillate products withdrawn from different trays of the column are then stripped by steam in their corresponding side strippers for removing lighter components to meet the products ASTM distillation specifications. The liquid falling downwards to the bottom from the flash zone is stripped using the steam.

Crude distillation unit is the largest and huge energy intensive among all petroleum processing units. The distillate products obtained from atmospheric distillation are more valuable than residue. Moreover, the demand of gas oil fraction is also increasing continuously worldwide. In view of this, designing a crude distillation unit for maximum distillate yield, particularly of gas oil, with minimum energy consumption could be main objectives of any designer. There are traditional techniques for increasing the distillate yields, which has its own limitations, such as increasing bottom stripping steam which is limited by increase in energy consumption, two phase formation (water saturation limit) at the plate of distillation and size (diameter) of the column, lowering the pressure of flash zone which is also limited by acid gas dew point temperature at top of the column, increasing furnace coil outlet temperature which is also limited by cracking characteristics of crude and increased energy consumption. The application of the flash drum and prefractionation column with main distillation column is reported in prior art to provide some energy savings. However, the major drawbacks of preflash and main distillation column combination is lower distillate yields generation in comparison to using the single main column due to loss of carrier effect of lighter fraction removed from the crude during the preflashing and requirement of significantly more space (diameter) and energy to process this additional distillate in vacuum column. However, in the preflash and distillation column integrated system, the distillate products in which there will be change in the yields depends on number of variables such as type of preflash i.e preflash drum or prefractionation column, feed temperature to preflash device, type of crude and vapor entry location in column [Ji and Bagajewicz, 2002; Errico, M., et. al. 2009, S. W. Golden, 1997]

Accordingly, still there is need for new method for improvement in the prior art of the crude distillation for increasing the distillate yield particularly, of gas oil to meets its increasing demand in gas oil driven society, energy savings for reducing green house gas emission and operating cost, and decreasing the yields of lower value distillates and residue by better fractionation in distillation column to increase the unit profit margin. Therefore, the innovation that can overcome these challenges described above will be of great importance. The importance of the innovation will be further augmented if; it can be implemented in a number of existing refineries economically and easily.

OBJECTIVES OF THE INVENTION

Accordingly, main objective of the present invention is to provide a method for increasing gas oil yield and energy efficiency in crude oil distillation.

Another objective of the present invention is to provide a method of separating components of the crude oil.

Yet another objective of the present invention is to meet the above objective without increasing the furnace coil outlet temperature to avoid the thermal cracking of crude oil.

Yet another objective of the present invention is to meet the above objective without increasing the stripping steam to minimize the condenser load, energy consumption in steam generation, and sour water stripper load.

Yet another objective of the present invention is to meet the above objective without lowering the pressure of flash zone which is limited by acid gas dew point temperature at top of the column.

Still another objective of the present invention is to provide method to increase the capacity of the crude distillation by debottlenecking the furnace and distillation column.

Yet another objective of the present invention is to provide method to increase the distillate yields significantly in atmospheric distillation column for energy and capital savings in vacuum crude distillation.

Yet another objective of the present invention is to reduce capital cost of atmospheric crude distillation column in the grass root design by reducing its vapor load and cross section area.

Still another objective of the present invention is to provide a new method for increasing gas oil yield and energy efficiency in crude oil distillation which can be implemented in the existing refineries easily and economically.

SUMMARY OF THE INVENTION

The present invention provides a method which utilizes low level energy in crude oil distillation unit, superheating of lighter fraction of crude, its application in the striping zone of column, and innovative utilization of water for enhanced vaporization of crude in preflash drum for increasing in distillate yields, particularly of gas oil, increasing energy efficiency in crude distillation, debottlenecking the distillation column and furnace to enhance the process capacity.

It can be understood by a person skilled in the art of crude distillation that increase in distillate yields particularly, of gas oil can be accomplished by increasing the column bottom stripping steam which remove the gas oil range material from the residue or by increasing the furnace coil outlet temperature which reduce the gas oil material solubility in the residue. The present invention relies on the new and innovative method for increasing the distillate yield and energy efficiency and debottlenecking of distillation column for capacity enhancement.

In the present invention, the lighter fraction of crude is separated using the flash drum. This lighter fraction of crude was superheated using the hot process steams and furnace to the desired temperature and subsequently it was injected to bottom stripping section of the column at a location somewhere in between the flash zone and bottom or at the bottom along with stripping steam or without striping steam (FIG. 1).

In another alternative of the present invention, some part of water from condenser is added to the desalted crude to eliminate the requirement of bottom stripping steam and to further improve the gas oil yield (FIG. 2).

In yet another alternative of the present invention, the steam is mixed with the lighter fraction of crude either before its entry to the heat exchanger network or its entry to the furnace. The mixed superheated stream is injected at the bottom of the column (FIG. 3).

In another alternative of the present invention, two flash stages at two different temperature can be used to enhance the utilization of low level energy, where liquid from the first flash drum is again heated and fed to second stage flash drum whereas vapor from both the flash stages are mixed, and then mixed vapor and liquid from the second stage are treated in same way as described above (FIG. 4).

The objectives of increased gas oil yield, energy saving and reduction in vapor load in the column were achieved without increasing furnace coil outlet temperature, at much reduced or without bottom stripping steam and reduced heating energy requirement.

Accordingly, the present invention provides a method for increasing gas oil yield and energy efficiency in crude oil distillation, wherein the said process comprising the steps of;

a. separating a lighter fraction (7) and a liquid fraction (5) from a desalted crude oil by passing desalted crude oil through one or more flash drum;
b. superheating the lighter fraction (7) by passing through furnace (F2) to obtain superheated lighter fraction;
c. injecting the superheated lighter fraction (8) to a tray placed between bottom and a flash zone of a stripping column (10), wherein the stripping column (10) has plurality of trays;
d. heating the liquid fraction (5) in furnace (F1) and feeding the heated liquid fraction (6) to a the feeding zone tray placed above stripping section of column (10); and
e. distilling the above and passing the distillates to side strippers (14, 15, and 16) from different trays of the stripping column (10), to obtain lighter products and residue.

In an embodiment of the present invention, the either furnaces (F1) or (F2) has separate coil arrangement for simultaneously superheating the lighter fraction and heating the liquid fraction before supplying to column (10).

In one embodiment of the present invention, the lighter fraction of crude (7) is mixed with steam before feeding to the furnace (F2).

In another embodiment of the present invention, the liquid fraction of crude (5) from one or more flash drum is subjected to separation in another-flash drum before feeding to the stripping column.

Still in another embodiment of the present invention, the lighter fraction from the another-flash drum is mixed with the lighter fraction of one or more flash drums.

Still in another embodiment of the present invention, the heat from stripping column is removed by one or more pump-rounds (PA1, PA2 and PA3) and at least one condenser (13) connected to the stripping column.

Still in another embodiment of the present invention the lighter fraction of crude is preheated in a heat exchanger before fed to the furnace (F2).

Still in another embodiment of the present invention the liquid fraction of crude is preheated (280-320° C.) in a heat exchanger before fed to the furnace (F1).

Still in another embodiment of the present invention the desalted crude is entering the preflash drum (4) in temperature range of 180-260° C.

Still in another embodiment of the present invention the amount added water to desalted crude in range of 2000-6000 kg/hr and bottom stripping steam in range of 0-10000 kg/h.

DETAILED DESCRIPTION OF THE INVENTION

To describe the present invention in detail, reference is made to the FIGS. 1, 2, 3 and 4.

Figure 1:
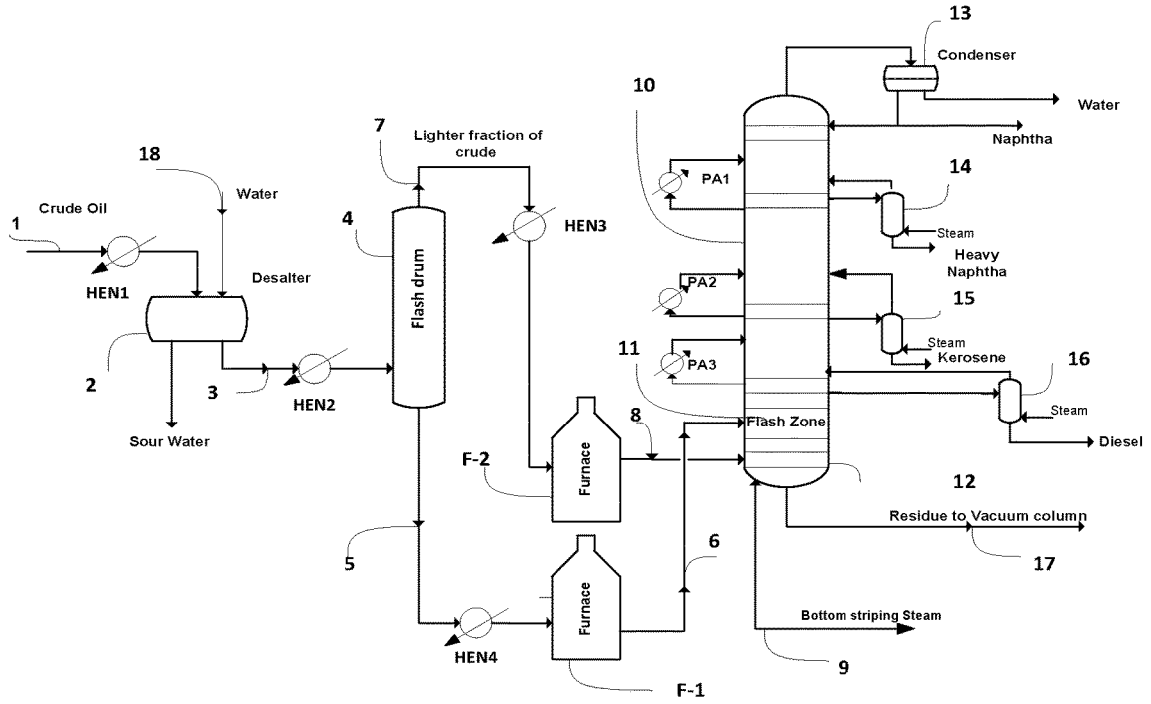
FIG. 1 is a systematic representation of a method for increasing gas oil yield and energy efficiency in crude oil distillation utilizing the separation and innovative application of lighter fraction of crude, constructed in accordance of the present invention.

FIG. 1 illustrates a method for increasing gas oil yield and energy efficiency in crude oil distillation utilizing separation, superheating and innovative application of lighter fraction of crude in crude distillation column. Crude oil 1 first heated in heat exchanger network HEN1 (125° C.) and fed to desalter 2 where it comes in the contact of water 18 to remove the water soluble salt. Desalted crude is further heated in exchanger network HEN2 using hot process stream to the temperature of 215° C. The heated crude is fed to flash drum 4 to separate vapor and liquid. Liquid 5 from flash drum is heated in heat exchanger network HEN4 prior to it enters the furnace F1 to obtain the temperature of 364.5° C. The vaporized crude 6 is fed to the flash zone 11 of the main column 10. The lighter fraction of the crude 7 from the flash drum 4 is routed to the furnace F2. Though, stream 7 can also be heated in furnace F1 (364.5° C.) if furnace has the separate coil arrangement for liquid stream 5 and vapor stream 7. The superheated lighter fraction of the crude is fed to the bottom stripping section 12 of the column 10 somewhere between bottom and flash zone 11. Heat from the column is removed using the heavy naphtha, kerosene, and gas oil pump rounds; PA1, PA2 and PA3 respectively, and condenser 13. Distillate products drawn from the different tray of the column are routed to side strippers 14, 15, & 16 where lighters from the products are removed using the steam. The vapor from the side stripper is returned back to the column. Bottom stripping steam 9 is fed at the bottom of the column to minimize the gas oil range fraction in the residue 17.

Figure 2:
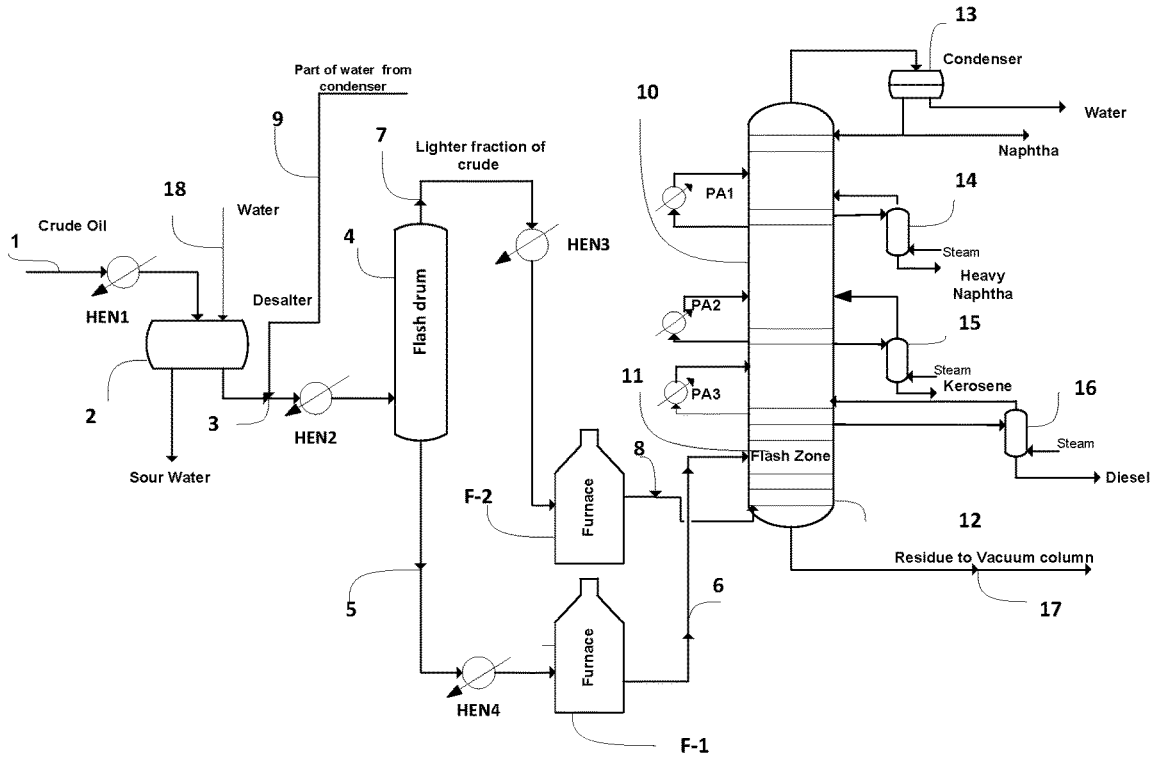
FIG. 2 is a systematic representation of another variation of method described above, constructed in accordance of the present invention

FIG. 2 illustrates another variation of method described above of the present invention. In this variation some part of water 9 (2000-6000 kg/hr) from condenser is added to the desalted crude 3.

Figure 3:
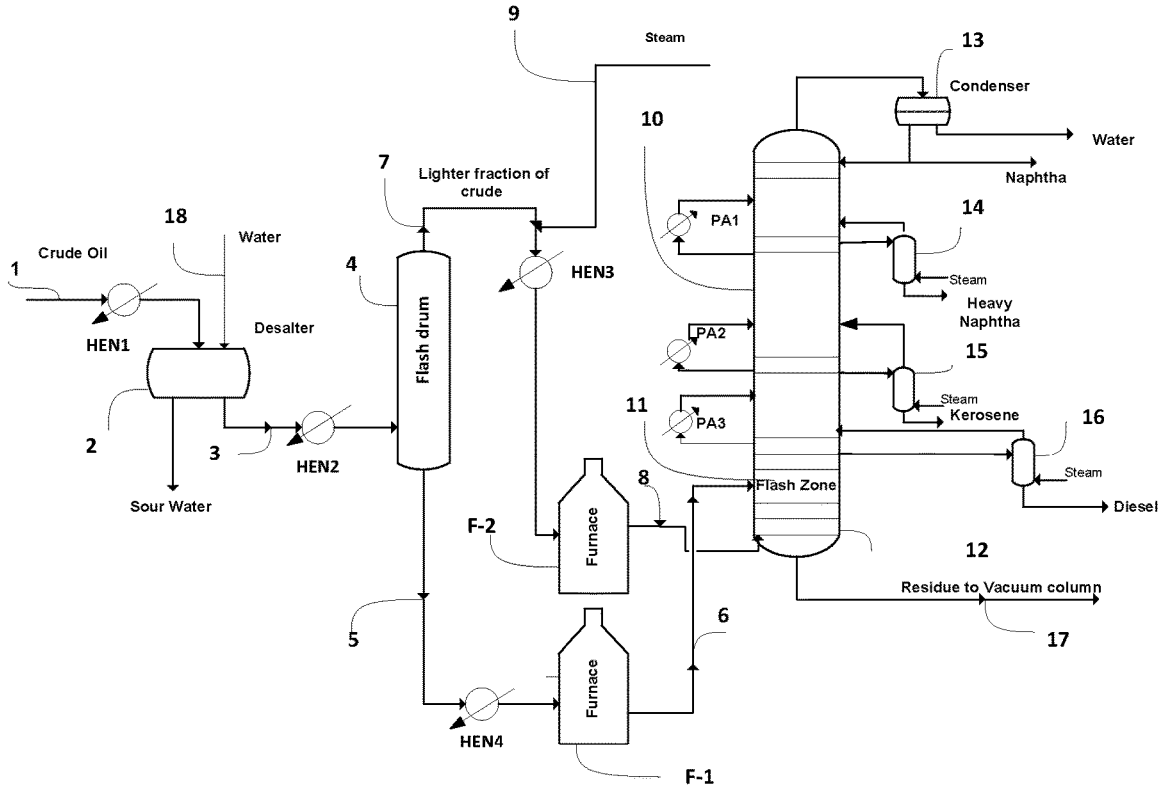
FIG. 3 is a systematic representation of yet another variation of method described above, constructed in accordance of the present invention.

FIG. 3 illustrates yet another variation of method described above of the present invention. In this variation steam 9 is mixed with the lighter fraction of crude 7 separated in the flash drum. It is also to note that steam can be mixed with the lighter fraction of crude 7 either before lighter fraction entering to the heat exchanger network or its entering to the furnace. The mixture of thereof is superheated using the heat exchanger network HEN3 and furnace F2. The superheated mixture is injected at the bottom of the distillation column 10. However, it is to be understood that this superheated vapor 8 may be entered anywhere in the stripping section 12 of the column 10.

Figure 4:
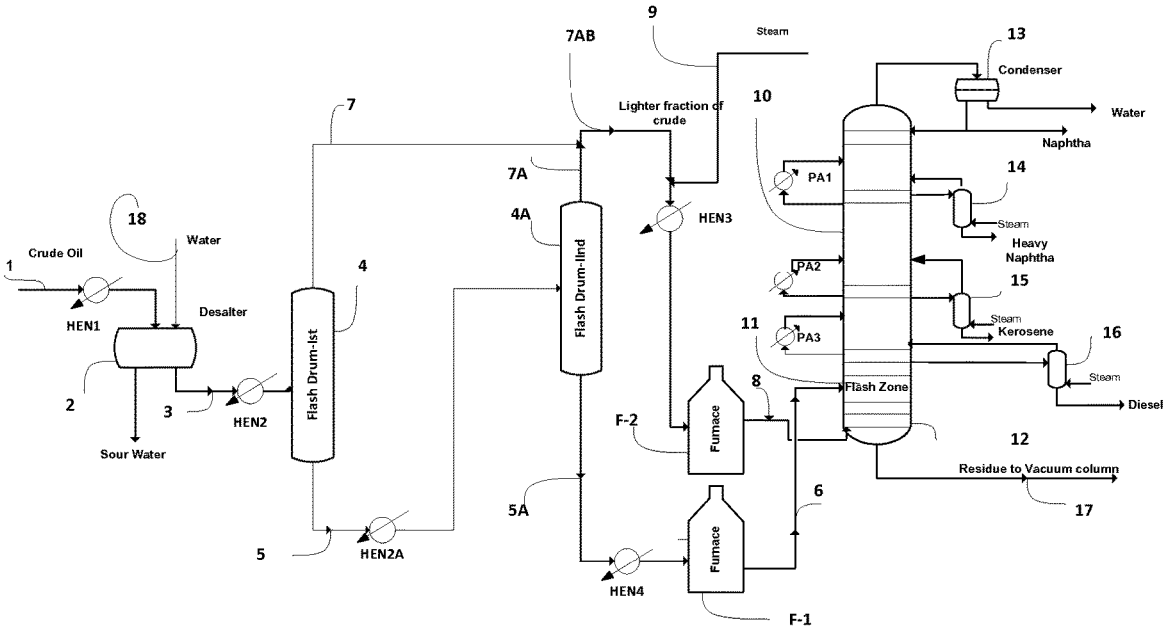
FIG. 4 is a systematic representation of yet another variation of method described above, constructed in accordance of the present invention.

FIG. 4 illustrates another variation of method described above of the present invention. The liquid from the flash drum-1st is heated in HEN2A and fed to flash drum 4A. Lighter fraction of crude from flash drum 4 and 4A are mixed. The liquid from the flash drum 4A and mixed lighter fraction stream 7AB are treated in the same fashion as described above for FIG. 1. The variation of using the combined lighter fraction of crude using the multiple flash stages and using the methodology described in FIGS. 2 and 3 also falls within the scope of present invention.

In the present invention lighter fraction of crude can be generated by using the single or multiple flash stages in the temperature range of 170 to 260° C. This lighter fraction from flash drum alone as shown in FIG. 1 or steam and lighter fraction mixed steam superheated in the temperature range of 260 to 360° C. using the process steam heat exchangers and furnace is injected to the stripping section of the column somewhere in between the flash zone and bottom or at the bottom.

Though, application of flash drum in distillation unit is reported in the prior art for energy savings, but vapor from flash drum is routed either to the column somewhere above the flash zone without further heating. In another variation reported some part of vapor is mixed with the crude entering to the furnace directly and rest to column above the flash zone. Yet in another variation vapor from flash drum is further fractionated by using cooler and second stage flash drum and vapor from the second flash drum without further heating is either again routed to the column somewhere above the flash zone or mixed with the crude coming from the first flash drum entering to the furnace.

It is also reported that when flash drum vapor is fed to the column at some location above the flash zone, there is a significant loss of distillate yields; however, some energy saving potential can be attained.

The novelty of the present invention resides in obtaining the significantly increased yield of gas oil by improved separation in column, increased total distillate (liquid products from atmospheric distillation column) and gas oil yield by improved separation in column and enhanced gas oil separation from residue without increasing the furnace coil outlet temperature using significant lower or without stripping steam at significant lower energy consumption. Further, reduced stripping steam improves the fractionation between gas oil and kerosene thereby results in increase in the gas oil yield. The reduction in stripping steam amount reduces the volumetric vapor load in the distillation column drastically due to its very low molecular weight (18) and creates the scope of capacity enhancement of unit without any revamp in the column. Reduction in stripping steam also results in lower condenser duty as latent heat of water vapor is very high. The invention also creates the process flexibility for increasing distillate and gas oil yield to desired extent possible by increasing the stripping steam up to the level used in the design of the column without crossing the column allowable vapor load based on the column diameter (hydraulics). The increase in the distillate yields in atmospheric column will also reduce the size requirement of the vacuum column, as one pound of vaporized oil under vacuum requires a space of several times larger than that required at atmospheric pressure. Moreover, increase in distillate yield also provides huge energy saving potential to be incurred for processing the reduced residue in vacuum column by reducing the energy requirement in the vacuum system which is used to remove the leaked air, non condensable in the oil and light olefins formed during the cracking etc.

The integrated atmospheric and vacuum distillation unit always has significant amount of energy in the temperature range of 170 to 250° C. Some part of this energy is generally used for steam generation and rest goes in cooling water. Present invention provides opportunity to upgrade this low level energy to high level energy which will result in furnace duty reduction.

ADVANTAGES OF INVENTION

Utilization of present invention has number of distinct advantages over prior art methods.

- Increase gas oil significantly for the same amount of residue produced as in the basis.
- Increase in distillate and gas oil yields significantly which is favorable in the gas oil driven economy with significant lower energy consumption.
- Eliminates the possibility of heavy hydrocarbon entrainment in the lighter distillate products due to lighter fraction injection below the flash zone.
- The invention is so much reliable and easy to implement that it can be applied in number of existing refineries.
- The column size requirement decreases due to lower vapor load which governed by the amount of stripping steam required to avoid the gas oil carry over with residue and internal refluxes requirement to meet the distillate quality specification.
- The invention described herein also provides an opportunity for capacity enhancement of existing system by debottlenecking the furnace hydraulics, heat duty, column hydraulic, and condensation duty.
- Reduction in stripping steam will also reduce the sour water stripper load and further will add to the energy and capital savings.
- The increase in distillate yield provides capital savings potential to be incurred during the processing of the residue in vacuum column by reducing the size of vacuum column (one lb of vaporized oil in vacuum require a space of several times larger than that required at atmospheric pressure).
- Energy savings will not only reduce the operating cost incurred on fuel but also decrease the GHG emission from the crude unit to environment and make the process cleaner and greener.

EXAMPLES

The following five examples are given by way of illustration to substantiate the invention and therefore should not be construed to limit the scope of the invention. The properties of typical lighter crude used in these examples are given in Table 1.

TABLE 1

| Crude properties | | | |
|---|---|---|---|
| Specific Gravity @ 15° C. | | 0.8282 | |
| **Light end analysis** | | | |
| Component | Volume % | Component | Volume % |
| Methane | 0.000 | n-Butane | 1.242 |
| Ethane | 0.090 | Iso-Pentane | 1.000 |
| Propane | 0.414 | n-Pentane | 1.850 |
| Iso Butane | 0.414 | | |
| **TBP distillation range of crude oil** | | | |
| Volume % | Temperature, ° C. | Volume % | Temperature, ° C. |
| 5.0 | 40.7 | 50.0 | 267.7 |
| 10.0 | 75.6 | 70.0 | 379.3 |
| 30.0 | 162.1 | 90.0 | 475.9 |
| 40 | 217.1 | 95.0 | 535.2 |

Example 1 and 2 are exemplary and constructed for establishing the basis to compare the quantitative advantages of the present invention. Example 3 and 4 illustrate the scope of increase of gas oil yield for same quantity of residue as generated in example-1. The example-5 illustrates the scope of increase in total distillate and gas oil yield in the present invention at reduced energy consumption.

Example 1

Crude is heated to a typical furnace coil outlet temperature of 364.5° C. and fed to the flash zone of the column containing 40 numbers of trays. The vapor from flash zone is fractionated in the four distillate products vis-à-vis top product, heavy naphtha, kerosene and gasoil. Liquid falling from flash zone is withdrawn from bottom of the column. The stripping steam in the stripper is used to remove the lighter fraction from the product to meet the products ASTM D-86 distillation five volume percent point temperature. The bottom stripping steam of 8500 kg/hr is used to obtain the liquid distillate yield (products lighter than residue) of 66.11 volume percent predicted from TBP curve with the final boiling point of 370° C.

The other details of operating parameters and column used in the examples are given in Table 2.

TABLE 2

| Operating parameters and atmospheric column detail | | | |
|---|---|---|---|
| Crude flow, tone/hr | 62.5 | Total number of trays | 40.0 |
| Crude entry at tray number | 6.0 | Striper trays efficiency | 0.4 |
| **Efficiency for different section of column** | | | |
| From Tray | To Tray | Efficiency | |
| 40.0 | 32.0 | 0.65 | |
| 31 | 29.0 | 0.30 | |
| 28 | 22.0 | 0.55 | |
| 21 | 19.0 | 0.30 | |
| 18 | 15.0 | 0.55 | |
| 12 | 14.0 | 0.30 | |
| 7 | 11.0 | 0.55 | |
| 6 | 1.0 | 0.40 | |

TABLE 2-continued

| Operating parameters and atmospheric column detail | | | | |
|---|---|---|---|---|
| Pump around detail | | | | |
| | Draw tray | Return tray | Flow [m3/h] | Temperature drop, ° C. |
| Heavy naphtha | 29 | 31 | 349976.6 | 60.0 |
| Kerosene | 19 | 21 | 539188.7 | 40.0 |
| Gas oil | 12 | 14 | 614544.8 | 50.0 |
| Strippers and Stripping steam detail | | | | |
| | No of trays | Liquid Draw tray | Vapor Return tray | Stripping steam, Kg/hr |
| Heavy naphtha | 6 | 29 | 31 | 1624.0 |
| Kerosene | 6 | 19 | 21 | 2117.0 |
| Gas oil | 4 | 12 | 14 | 2066.0 |
| Column bottom | | | | 8500.0 |

It is understood that quality of distillate products from the crude unit are characterized by the temperatures corresponding to their 5 and 95 volume percent along with meeting the density and flash point requirement. The performance of a crude distillation is evaluated using the ASTM 5-95 gaps separation criteria.

Accordingly, in this basis example, 95 volume percent temperature of the distillate products vis-à-vis top product, heavy naphtha, kerosene and gas oil to the value of 110, 160, 245 and 370° C., respectively, were fixed to predict the distillate yields using the typical number of trays used in the distillation column of actual refinery. The required amount of stripping steam was used in the strippers to maintain the desired 5 volume percent ASTM D-86 distillation temperature of the distillate products. The values of striping steam used were given in Table 2. The heavy naphtha, kerosene and gas oil pump around were used to remove the heat at different temperature level from the column as per detail shown in Table 2.

The residue obtained from the atmospheric distillation column is processed in vacuum column. The details of operating conditions and vacuum column are given in Table 3.

TABLE 3

| Operating parameters and Vacuum column detail | |
|---|---|
| Residue flow, Std ideal liquid flow, $m^3/h$ | 257.4 |
| Total number of theoretical trays | 14.0 |
| Residue entry tray number | 3.0 |
| Bottom stripping steam, Kg/h | 600.0 |
| Furnace coil steam, kg/h | 600.0 |
| Light ends, Std ideal liquid flow, $m^3/h$ | 5.2 |

| Pump around detail | | |
|---|---|---|
| Pump around name | Draw tray | Return tray |
| Vacuum Gas oil | 13 | 14 |
| LVGO | 8 | 9 |
| HVGO | 6 | 7 |

TABLE 3-continued

| Operating parameters and Vacuum column detail | | |
|---|---|---|
| Pump around name | Flow [$m^3/h$] | Temperature drop, ° C. |
| Vacuum Gas oil | 100.0 | 115.0 |
| LVGO (light vacuum gas oil) | 113.0 | 86.9 |
| HVGO (high vacuum gas oil) | 350.0 | 63.7 |
| Product detail | | |
| Product detail | | |
| Product name | Draw tray | Flow [$m^3/h$] |
| Vacuum Gas oil | 13 | 39.8 |
| LVGO | 81 | 92.0 |
| HVGO | 6 | 68.9 |

The products yields, products separation Gap (5-95 Gaps), ° C., and the maximum vapor load in the column obtained in this example are given in Table 4.

TABLE 4

| Results obtained in example 1 | |
|---|---|
| Column Top product, $m^3/h$ | 129.9 |
| Heavy naphtha product, $m^3/h$ | 68.2 |
| Kerosene product, $m^3/h$ | 118.7 |
| Gas oil product, $m^3/h$ | 183.1 |
| Residue, $m^3/h$ | 257.4 |
| Products separation Gap (5-95 Gap), ° C. | |
| Top product-Heavy naphtha | 0.2 |
| Heavy naphtha-Kerosene | −4.6 |
| Kerosene-Gas oil | −13.0 |

Example 2

This example of present invention illustrates the effect of preflash drum on distillate yield in the atmospheric distillation column in crude distillation unit. The operating parameters such as crude temperature to flash zone temperature, column top and bottom pressure, number of trays in the distillation column, trays efficiency, crude entry location, 95% temperature of distillate products, pump arounds draw and return stages and flow rates, products draw stages, striper tray number and tray efficacy, used in this example are same as used in Example 1. In this example, crude is heated to a temperature of 215° C. and flashed at pressure of 4.2 $kg/cm^2a$. The vapor from the flash drum was routed to the $18^{th}$ tray in the main column considering the temperature of lighter fraction of crude vapor and column tray. The liquid from the flash drum is heated to a temperature of 364.5° C. which is same as in Example 1. It is observed that the distillates yields and temperature corresponding to the 5 volume percent of the products are much different than obtained in the Example 1. In view of this, to meet the separation criteria (quality) of the distillate products established in basis Example 1, temperature drop across pump arounds and stripping steam in gas oil and kerosene strippers were adjusted. The results for both the scenarios are given in Table 5.

TABLE 5

| Results obtained in example 2 | | |
|---|---|---|
| | Case without change in stripping steam and PA temperature drop | Case with change in stripping steam and PA temperature drop |
| Column Top product, $m^3$/hr | 121.4 | 130.3 |
| Heavy naphtha product, $m^3$/hr | 74.2 | 68.7 |
| Kerosene product, $m^3$/hr | 116.2 | 118.3 |
| Gas oil product, $m^3$/hr | 177.6 | 171.5 |
| Residue, $m^3$/hr | 268.0 | 268.5 |
| Products separation Gap (5-95 Gap), ° C. | | |
| Top product-Heavy naphtha | −8.8 | 0.4 |
| Heavy naphtha-Kerosene | −11.6 | −5.0 |
| Kerosene-Gas oil | −24.5 | −12.6 |
| Condenser duty, Mkcal/hr | 34.0 | 34.5 |
| Heavy naphtha stripper steam, kg/hr | 1624 | 1624 |
| Kerosene stripper steam, kg/hr | 2117 | 2617 |
| Gas oil Stripping steam, kg/hr | 2066 | 3066 |
| Column bottom steam, Kg/hr | 8500.0 | 8500 |

This example illustrates that flash drum integration with main crude distillation column decreases the distillate yield significantly. It is seen that for same product 5-95 separation gas (products quality), gas oil yield decreases by 6.5% in comparison to Example 1. The decrease in distillate yield shall require much more space in the vacuum distillation column due to very low pressure. Moreover, the stripping steam requirement in gas oil and kerosene strippers to meet the separation criteria is to be increased by 48.4 and 23.6% respectively. The increase in stripping steam will also increase the sour water stripper load.

Example 3

The operating parameters such as crude temperature to flash zone temperature, column top and bottom pressure, number of trays in the distillation column, trays efficiency, crude entry location, 95% temperature of distillate products, pump arounds draw and return stages and flow rates, products draw stages, striper tray number and tray efficacy, used in this example are also same as used in Examples 1 & 2.

To illustrate and substantiate the benefits and claims of present invention, three different scenarios were considered in this example.

Scenario-I: Preflash feed temperature-215° C., bottom stripping steam −8500 kg/hr Scenario-II: Preflash feed temperature-215° C., bottom stripping steam −3800 kg/hr Scenario-III: Preflash feed temperature-225° C., bottom stripping steam −3800 kg/hr The crude is heated to 215 (Scenario-I & II) & 225° C. (Scenario-III) temperature and flashed at pressure of 4.2 $kg/cm^2a$ in preflsh drum. The lighter fraction of crude from the flash drum can be superheated to the temperature of 364.5° C. using the hot process streams and furnace. Superheated lighter fraction of crude is then routed to $3^{rd}$ stage column from the bottom. The stripping steam of amount 8500 (Scenario-I) & 3800 (Scenario-II & III) kg/h was used at the bottom of the column. It is observed that temperatures corresponding to the 5 volume percent of the products are slightly different than obtained in the Example 1. Pump arounds temperature drops were adjusted slightly to meet the separation criteria of the distillate products as established in Example 1. The results obtained for all three scenarios are given in Table 6.

TABLE 6

| Results obtained in Example 3. | | | |
|---|---|---|---|
| | Scenario-I | Scenario-II | Scenario-III |
| Column Top product, $m^3$/hr | 130.6 | 129.2 | 129.2 |
| Heavy naphtha product, $m^3$/hr | 66.1 | 67.1 | 66.9 |
| Kerosene product, $m^3$/hr | 119.3 | 116.9 | 116.4 |
| Gas oil product, $m^3$/hr | 195.4 | 187.6 | 189.0 |
| Residue, $m^3$/hr | 246.1 | 256.5 | 255.8 |
| Products separation Gap (5-95 Gap), ° C. | | | |
| Top product-Heavy naphtha | 1.7 | 0.2 | 0.2 |
| Heavy naphtha-Kerosene | −5.0 | −4.6 | −4.7 |
| Kerosene-Gas oil | −10.8 | −13.0 | −13.0 |
| Gas oil-Residue | −17.7 | −37.4 | −37.6 |
| Column bottom Stripping steam, Kg/hr | 8500.0 | 3800 | 3800 |

This example illustrates the importance of innovative idea of superheating of lighter fraction of crude separated in flash drum and its application in stripping section of the column. Results obtained shown in Table 6 indicate that gas oil yield can be increased significantly in comparison to basis examples 1. Scenario-I results indicate that gas oil yield is increased by 6.7 and 13.9% in comparison to Examples 1 and 2 respectively. There is 55% reduction in bottom stripping steam. The increase in gas oil yield with reduced stripping steam in scenario II&III is attributed to the better fractionation between gas oil and kerosene fractions. In this example, two preflash drum feed temperatures of 215° C. and 225° C. and two value of stripping steam were studied just a way of illustration and present invention is, however, the invention is not limited to these temperature and stripping steam values.

Example 4

The operating parameters such as crude temperature to flash zone temperature, column top and bottom pressure, number of trays in the distillation column, trays efficiency, crude entry location, 95% temperature of distillate products, pump arounds draw and return stages and flow rates, products draw stages, striper tray number and tray efficacy, used in this example are same as used in Examples-3 (Scenario-I) except that lighter fraction of crude from the flash drum was not superheated. The results are given in Table 7.

TABLE 7

| Results obtained in example 4. | |
|---|---|
| Parameters | Value |
| Column Top product, $m^3$/hr | 129.2 |
| Heavy naphtha product, $m^3$/hr | 67.7 |
| Kerosene product, $m^3$/hr | 116.6 |
| Gas oil product, $m^3$/hr | 182.2 |
| Residue, $m^3$/hr | 261.7 |
| Products separation Gap (5-95 Gap), ° C. | |
| Top product-Heavy naphtha | −0.30 |
| Heavy naphtha-Kerosene | −4.66 |
| Kerosene-Gas oil | −12.68 |
| Gas oil-Residue | −48.44 |
| Bottom stripping steam, kg/hr | 8500 |

Results from table 6 (scenario-I) and table 7 reveals the impotence of superheating of lighter fraction of crude in the process. Results reveal that when lighter fraction of crude in the process is not superheated, the obtained gas oil yield is 182.2 $m^3$/h against 195.4 $m^3$/h, the residue temperature leaving the column is 297.3 C against 347° C., Gas oil-Residue products separation Gap (5-95 Gap) is −48.44 against −35.7. This suggests that superheating is required to increase the gas oil yield to its fullest extent, to avoid the lighter fraction slip in residue.

Example 5

The operating parameters such as crude temperature to flash zone temperature, column top and bottom pressure, number of trays in the distillation column, trays efficiency, crude entry location, 95% temperature of distillate products, pump arounds draw and return stages and flow rates, products draw stages, striper tray number and tray efficacy, used in this example are same as used in Examples-3 (Scenario-II) with following exceptions. Superheated lighter fraction is added at the bottom of the column; 3800 kg/hr water is added to desalted crude; and bottom stripping steam (3800 kg/h) is reduced to zero. The results are given in Table 8.

TABLE 8

Results obtained in example 5.

| Parameters | Value |
|---|---|
| Column Top product, $m^3$/hr | 127.0 |
| Heavy naphtha product, $m^3$/hr | 66.2 |
| Kerosene product, $m^3$/hr | 114.6 |
| Gas oil product, $m^3$/hr | 197.1 |
| Residue, $m^3$/hr | 252.3 |
| Products separation Gap (5-95 Gap), ° C. | |
| Top product-Heavy naphtha | 0.08 |
| Heavy naphtha-Kerosene | −4.53 |
| Kerosene-Gas oil | −12.92 |
| Gas oil-Residue | −38.18 |
| Bottom stripping steam, kg/h | 0.0 |

This example illustrate the innovative utilization of water to improve the distillate and gas oil yield further by 197.1 $m^3$/h against 187.6 $m^3$/h using the same amount of water as striping steam used in the example 3 (Scenario-II). This implies that present invention provide a method to increase the gas oil yield by 7.7% with significant benefit of zero striping steam.

Comparison of Energy Requirement and Maximum Vapor Flow Rate in Column

It is known that in crude distillation unit hot steams from the atmospheric and vacuum distillation columns exchange the heat with cold streams (crude, vapor from flash drum). The additional heat required for crude vaporization and crude lighter fraction vapor superheating will be provided by the furnace. Considering above, the minimum furnace duty requirement was estimated using the enthalpy of all the hot products with a typical rundown temperature used in the refinery and pump arounds with required return temperature using well established and proven pinch analysis method. The maximum vapor flow rate is taken from the hydraulic profile of the column. The heating and cooling energy requirements and maximum vapor flow for scenario of using the same the crude temperature to flash drum and gas oil same or higher than basis example-1 are given in Table-9.

TABLE-9

Comparison of energy and striping steam requirement and maximum vapor flow in column

| Parameters | Example-1 | Example-3 Scenario-I | Example-3 Scenario-II | Example-5 |
|---|---|---|---|---|
| Minimum furnace duty, Mkcal/hr | 54.60 | 49.60 | 44.47 | 44.27 |
| Bottom stripping steam, MMKcal/hr | 4.25 | 4.25 | 1.9 | 0 |
| Total heating energy | 58.85 | 53.85 | 51.5 | 44.27 |
| Minimum cold utility, Mkcal/hr | 36.5 | 31.8 | 43.29 | 42.53 |
| Condenser duty, Mkcal/hr | 34.1 | 35.7 | 31.30 | 30.64 |
| Total cooling energy, MMkcal/hr | 70.6 | 67.5 | 74.59 | 73.17 |
| Max vapor flow in column, m3/hr | 65414.1 | 65010.0 | 59984.0 | 59546.6 |
| Bottom stripping steam, kg/h | 8500.0 | 3800.0 | 3800.0 | 0.0.0 |

Note:
1 MMKcal/h = 2000 kg/h striping steam

Results in Table-9 clearly indicate that present innovation can reduce heating energy consumption by 19.7%, max vapor flow in column by 10.0% which will lead to lower column cross section area by 10%, bottom stripping steam by 100% which will result in significant reduction in sour water stripper load. This also illustrates that water addition to desalted crude will not only eliminate the bottom striping steam requirement but also reduces the furnace duty (Scenario-II and example-2) and enhances the gas oil yield.

What is claimed is:

1. A method for increasing gas oil yield and energy efficiency in crude oil distillation, the method comprising the steps of:

a. separating a lighter fraction vapor and a liquid fraction from a desalted crude oil by passing the desalted crude oil through one or more flash drums;

b. superheating the lighter fraction vapor by passing the lighter fraction vapor through a first furnace to obtain a superheated lighter fraction;

c. injecting the superheated lighter fraction vapor into a distillation column having a plurality of trays, the superheated lighter fraction vapor injected either at a bottom of the distillation column or at a stripping section located between a flash zone and the bottom of the distillation column;

d. heating the liquid fraction in a second furnace to obtain a heated liquid fraction and feeding the heated liquid fraction to the flash zone of the distillation column; and e. distilling the superheated lighter fraction and the liquid fraction and passing the distillates to side strippers from different trays of the plurality of trays of the distillation column, to obtain lighter products and residue.

2. The method as claimed in claim 1, wherein the lighter fraction of crude is mixed with steam before feeding to the first furnace.

3. The method as claimed in claim 1, wherein the one or more flash drums includes a first flash drum and a second flash drum, and passing desalted crude oil through one or more flash drums comprises:

passing the desalted crude oil through the first flash drum to separate a first lighter fraction and a first liquid fraction.

4. The method as claimed in claim 3 further comprising:

passing the first liquid fraction through the second flash drum to separate a second lighter fraction and a second liquid fraction; and combining the first and second lighter fractions downstream of the second flash drum and upstream of the distillation column.

5. The method as claimed in claim 1, wherein the heat from the distillation column is removed by one or more pump-rounds and at least one condenser connected to the distillation column.

6. The method as claimed in claim 1, wherein the lighter fraction vapor of crude is preheated in a heat exchanger before the lighter fraction vapor is fed to the first furnace.

7. The method as claimed in claim 1, wherein the liquid fraction of crude is preheated (280-320° C.) in a heat exchanger before the liquid fraction is fed to the second furnace.

8. The method as claimed in claim 1, wherein the desalted crude is entering the one or more flash drums in a temperature range of 180-260° C.

9. The method as claimed in claim 1 further comprising:

adding water to the desalted crude upstream of the one or more flash drums and downstream of a desalter, wherein the water is added in a range of 2000-6000 kg/hr.

10. The method of claim 1 further comprising:

feeding steam through the bottom of the distillation column in a range of 0-10000 kg/h.

* * * * *